US011278114B2

(12) United States Patent
Jeon

(10) Patent No.: US 11,278,114 B2
(45) Date of Patent: Mar. 22, 2022

(54) PORTABLE READING STAND

(71) Applicant: Boin Jeon, Gyeonggi-do (KR)

(72) Inventor: Boin Jeon, Gyeonggi-do (KR)

( * ) Notice: Subject to any disclaimer, the term of this patent is extended or adjusted under 35 U.S.C. 154(b) by 0 days.

(21) Appl. No.: 17/056,194

(22) PCT Filed: Dec. 27, 2019

(86) PCT No.: PCT/KR2019/018601

§ 371 (c)(1),
(2) Date: Nov. 17, 2020

(87) PCT Pub. No.: WO2020/184823

PCT Pub. Date: Sep. 17, 2020

(65) Prior Publication Data

US 2021/0212454 A1 Jul. 15, 2021

(30) Foreign Application Priority Data

Mar. 13, 2019 (KR) ..... 10-2019-0028464
Aug. 9, 2019 (KR) ..... 10-2019-0097403

(51) Int. Cl.
*A47B 23/00* (2006.01)
*A47B 23/04* (2006.01)
*A47B 23/06* (2006.01)

(52) U.S. Cl.
CPC ..... *A47B 23/043* (2013.01); *A47B 23/06* (2013.01)

(58) Field of Classification Search
None
See application file for complete search history.

(56) References Cited

U.S. PATENT DOCUMENTS 4,460,146 A * 7/1984 Raggiotti ..... A47G 1/24 248/456
5,765,799 A * 6/1998 Weber ..... A47B 23/044 248/453

(Continued)

FOREIGN PATENT DOCUMENTS

KR 20-0437105 Y1 11/2007
KR 20-0472673 Y1 5/2014

(Continued)

OTHER PUBLICATIONS

International Search Report for PCT/KR2019/018601 dated Apr. 8, 2020.

*Primary Examiner* — Steven M Marsh
(74) *Attorney, Agent, or Firm* — The PL Law Group, PLLC

(57) ABSTRACT

A portable reading stand may include a main body panel, a base plate to be rotatable on one side of one surface of the main body panel to support a lower portion of a book, and a supporter on the other surface of the main body panel to obliquely support the main body panel. The base plate is configured such that one side is rotatably coupled to one side of a base accommodating unit on one side of the main body panel so that when the other side of the base plate is folded in a direction of the main body panel, the base plate is accommodated in the base accommodating unit. A cover is provided in a direction of one surface of the base accommodating unit, such that when the cover is closed while the base plate is unfolded or folded, the base accommodating unit is covered.

10 Claims, 11 Drawing Sheets

(56) References Cited

U.S. PATENT DOCUMENTS

| | | | | |
|---|---|---|---|---|
| 6,216,377 | B1 * | 4/2001 | Painsith | A47G 1/06 40/750 |
| 6,264,160 | B1 * | 7/2001 | Wells | A47B 23/043 248/453 |
| 6,971,622 | B2 * | 12/2005 | Ziegler | F16M 11/10 248/454 |
| 9,788,621 | B2 * | 10/2017 | Kim | B08B 3/022 |

FOREIGN PATENT DOCUMENTS

| | | | |
|---|---|---|---|
| KR | 10-2015-0076820 | A | 7/2015 |
| KR | 30-0840381 | S | 2/2016 |
| KR | 10-2016-0028919 | A | 3/2016 |
| KR | 10-2026051 | B1 | 9/2019 |

* cited by examiner

PORTABLE READING STAND

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2019/018601, filed Dec. 27, 2019, which claims priority to the benefit of Korean Patent Application Nos. 10-2019-0028464 filed on Mar. 13, 2019 and 10-2019-0097403 filed on Aug. 9, 2019 in the Korean Intellectual Property Office, the entire contents of which are incorporated herein by reference.

TECHNICAL FIELD

The present invention relates to a portable reading stand, and more particularly, to a reading stand having a thin and slim structure that is lightweight and easy to carry by allowing both a base plate and a supporter to be accommodated in a body.

DESCRIPTION OF THE RELATED ART

A reading stand is a kind of stationery that is used when reading books with a book on it. The reading stand has been used for a long time because it relieves fatigue by allowing one to read in a correct posture.

In recent years, as the number of people who read in libraries or cafés increases, more people carry the reading stand. However, since most of the conventional reading stands are made of wood, they have the disadvantage of being heavy. In addition, most of reading stands have a structure in which a base plate and a supporter are in close contact with a main body to fold. Therefore, there is a problem that it is inconvenient to accommodate a bag because the base plate and the supporter are folded in a form protruding from the main body.

Recently, various types of portable reading stands have been introduced to solve this problem. However, some of the portable reading stands have a problem in durability due to excessive emphasis on portability. Furthermore, some of them gave up some of the original functions of the reading stand to improve portability. Particularly, fixing members coupled to the base plate have been used for a long time due to their usefulness, but in the case of portable reading stands, some of these functions are often abandoned. In addition, there are many cases in which durability problems occur due to miniaturization by emphasizing only portability.

SUMMARY

The present invention is to solve the problems described above, and it is an object to provide a reading stand having a slim structure that does not protrude to the outside when the reading stand is folded so that both a base plate and a supporter are accommodated and folded in a main body.

According to an embodiment of the present invention in order to solve the problems described above, there is provided a portable reading stand, comprising: a main body panel having a plate-shaped structure with a thickness; a base plate provided to be rotatable on one side of one surface of the main body panel to support a lower portion of a book; and a supporter provided on the other surface of the main body panel to obliquely support the main body panel, in which one side of the main body panel is provided with a base accommodating unit, in which the base plate is configured such that one side is rotatably coupled to an inside of one side of the base accommodating unit so that when the other side of the base plate is folded in a direction of the main body panel, all of the base plate is accommodated in the base accommodating unit, in which a cover is provided on an upper portion of the base accommodating unit in a direction of one surface thereof, such that when the cover is closed while the base plate is accommodated, one surface of the cover is parallel to one surface of the main body panel and the base accommodating unit in which the base plate is accommodated is covered, and such that when the cover is closed while the base plate is unfolded, the cover covers the base accommodating unit.

In the portable reading stand according to the present invention, both the base plate and the base plate may be accommodated in the body. Therefore, even if one puts it in a bag with books or other portable items, there is no discomfort in storage or the base plate and the supporter are not caught on other items. In addition, it maintains all the configurations of fixing members and base plate, which have proven their usefulness in the prior art. Therefore, it improves portability without causing inconvenience in use.

BRIEF DESCRIPTION OF THE DRAWINGS

The above and other aspects and features of the present disclosure will become more apparent by describing in detail exemplary embodiments thereof with reference to the attached drawings, in which.

DETAILED DESCRIPTION OF THE EMBODIMENTS

Hereinafter, preferred embodiments of the present invention will be described in detail with reference to the accompanying drawings.

Figure 1:
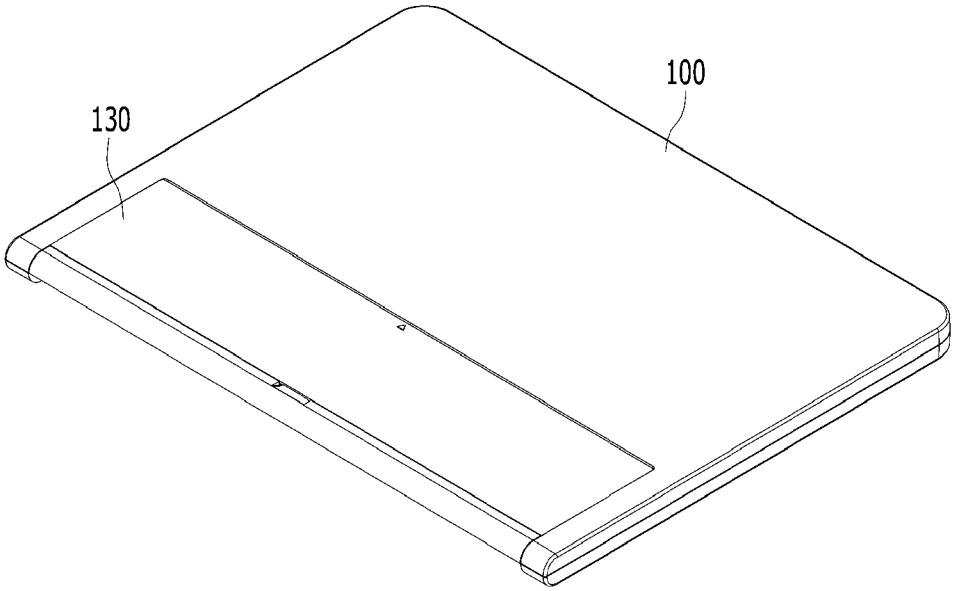
FIG. 1 is a perspective view of a folded state of a portable reading stand according to the present invention.
Figure 2:
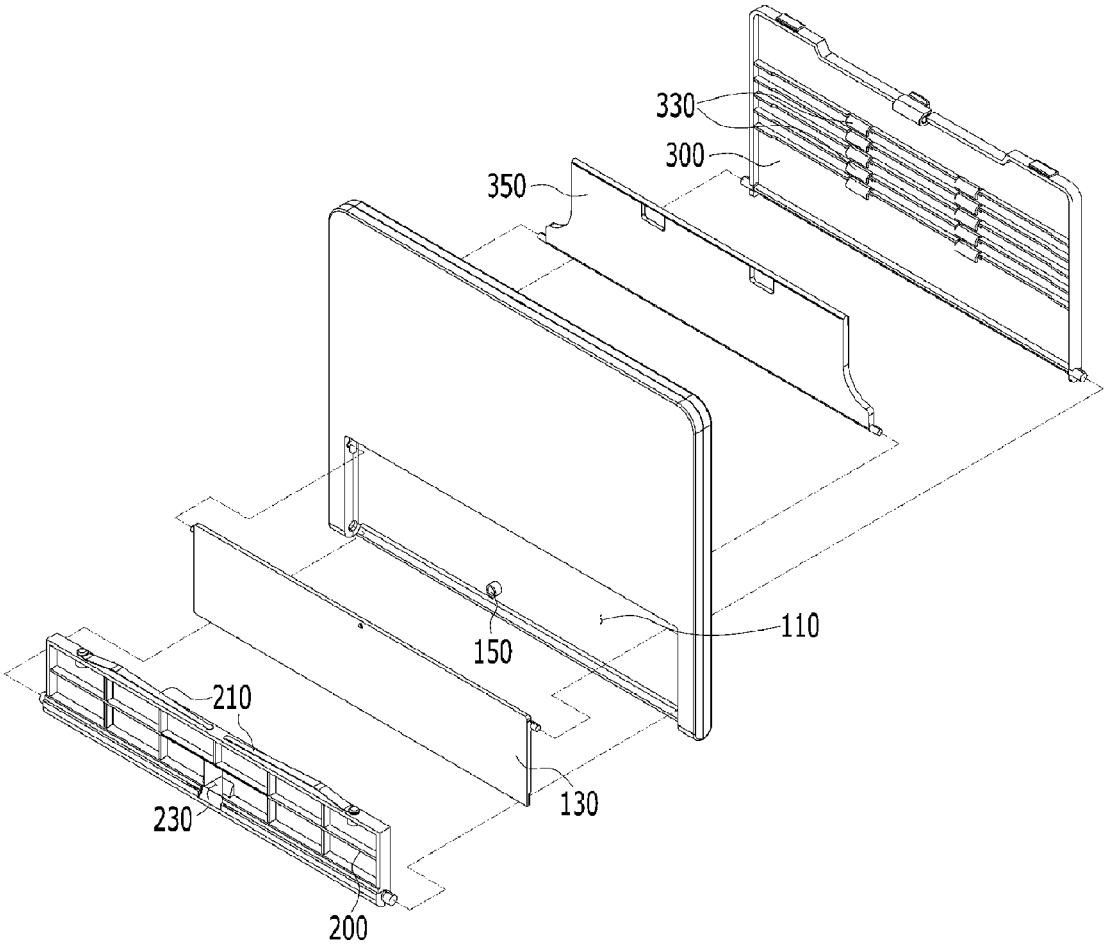
FIG. 2 is an exploded perspective view of the portable reading stand according to the present invention.
Figure 3:
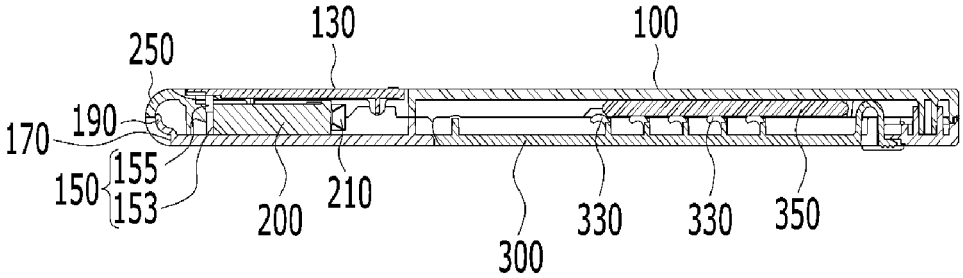
FIG. 3 is a side cross-sectional view in which a base plate is folded.
Figure 4:
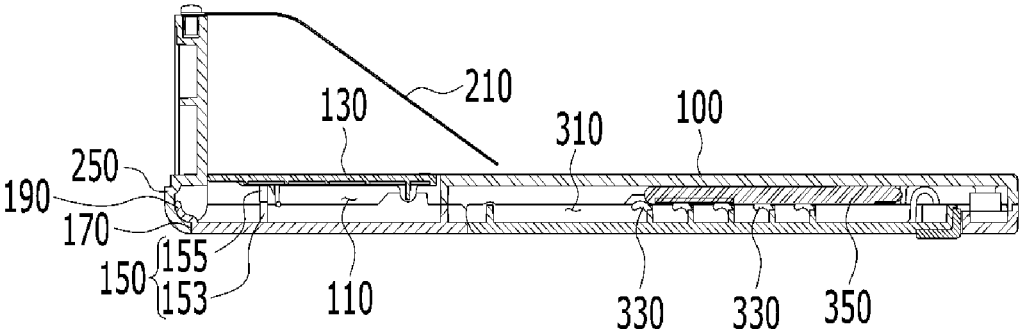
FIG. 4 is a side cross-sectional view in which the base plate is unfolded.
Figure 5:
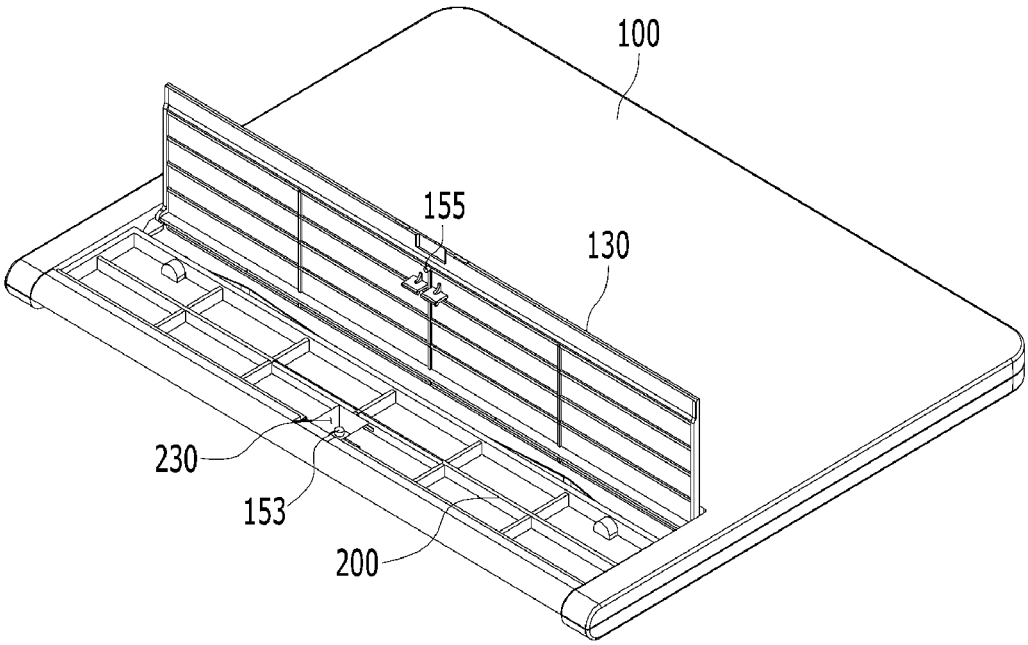
FIG. 5 is a perspective view showing a state in which a cover is opened.
Figure 6:
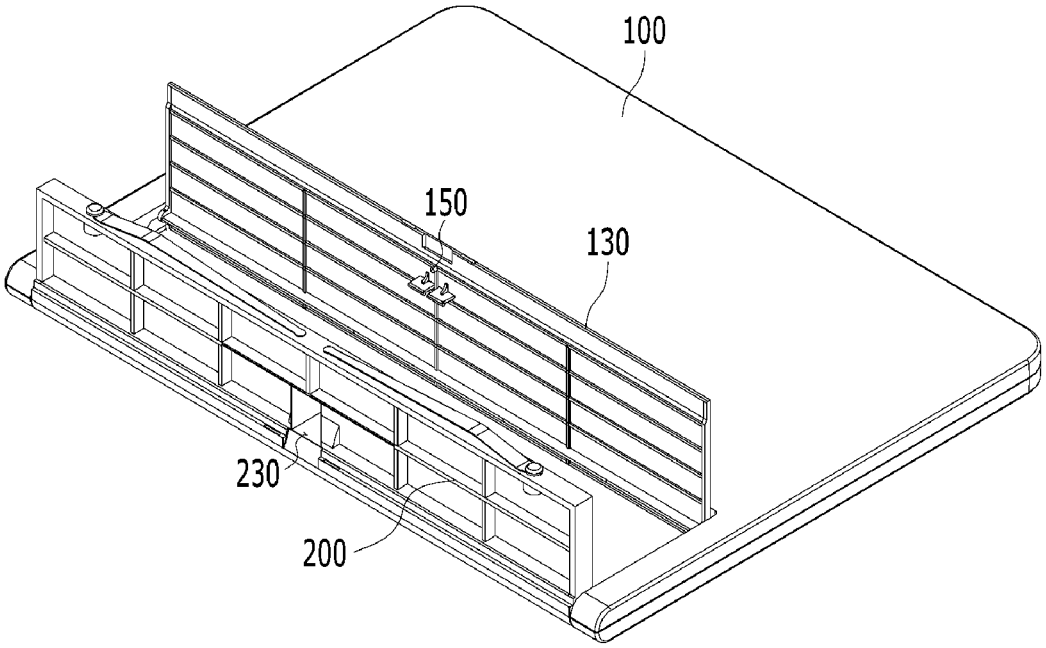
FIG. 6 is a perspective view showing a state in which the base plate is unfolded.
Figure 7:
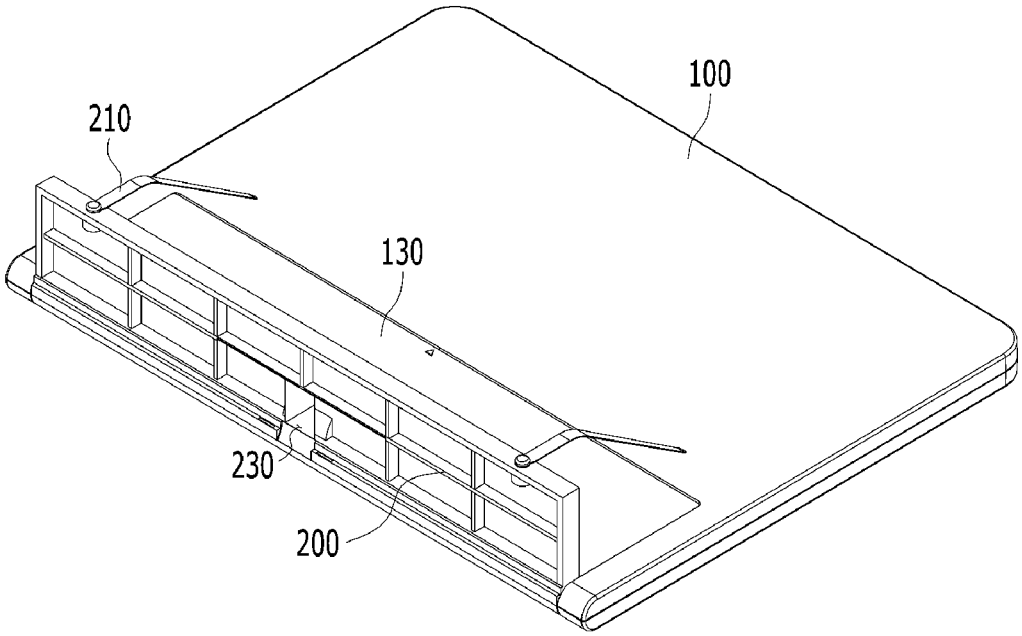
FIG. 7 is a view showing a state in which the cover is closed while the base plate is unfolded.
Figure 8:
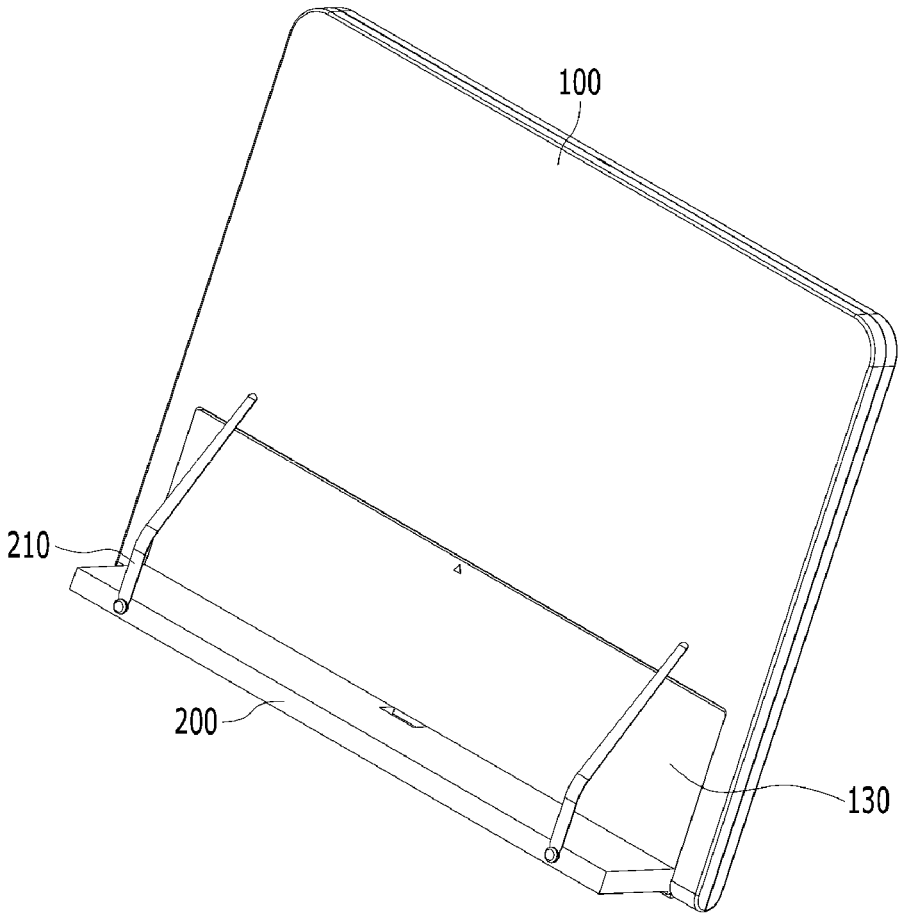
FIG. 8 is a perspective view showing a state in which the base plate is unfolded state.
Figure 9:
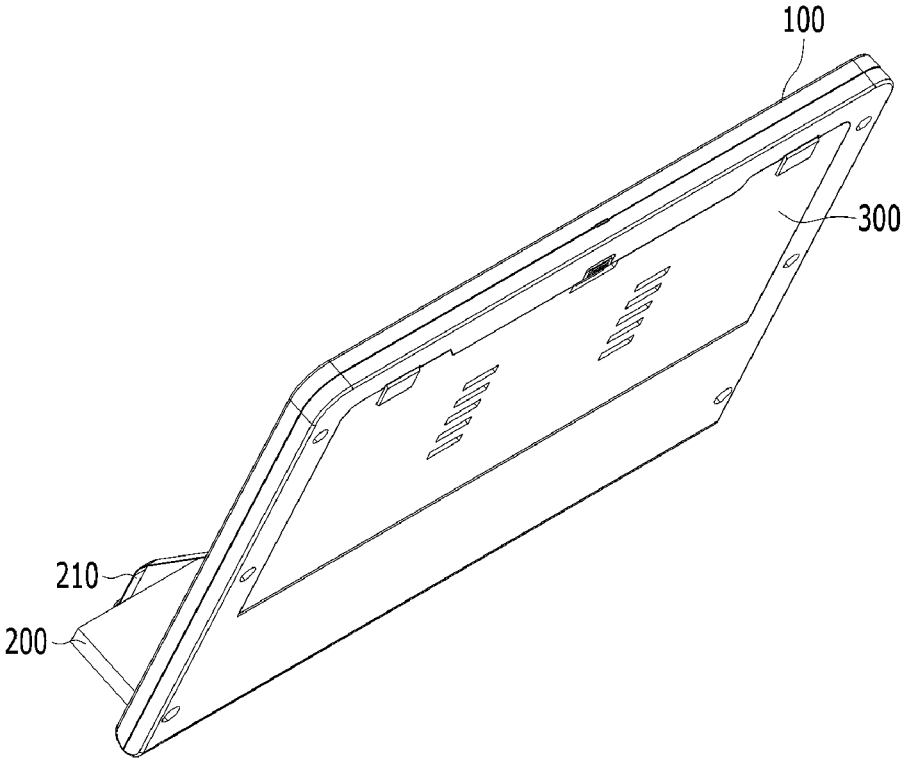
FIG. 9 is a perspective view showing the rear of the portable reading stand according to the present invention.
Figure 10:
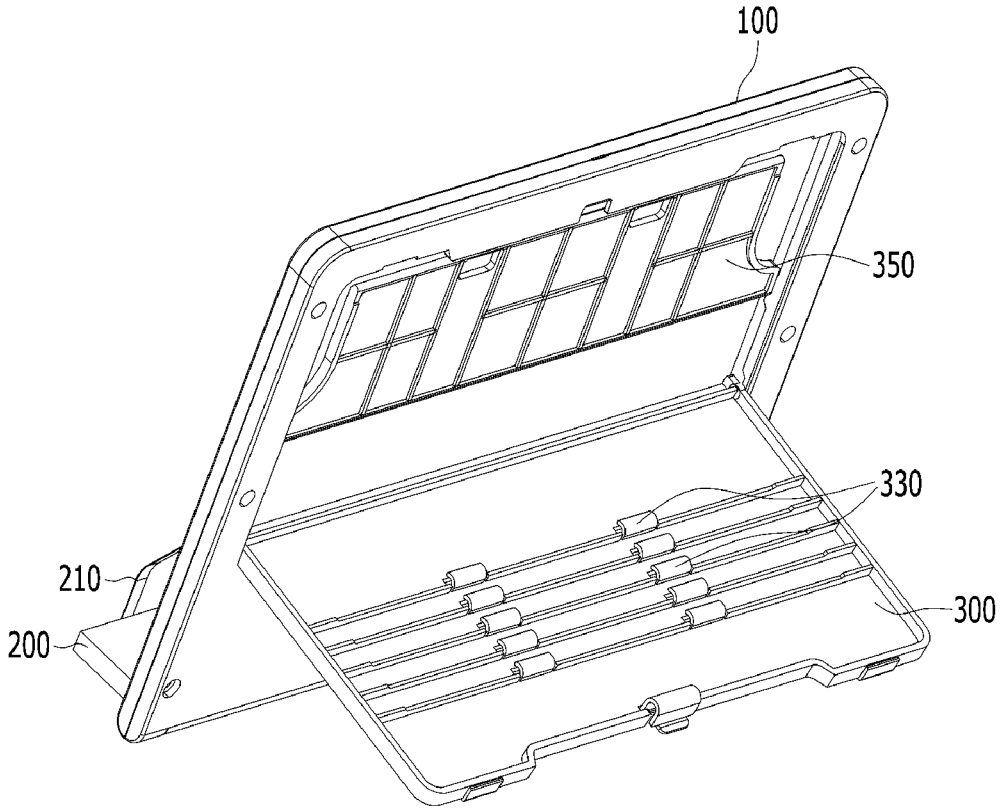
FIG. 10 is a perspective view showing a state in which a supporter is unfolded.
Figure 11:
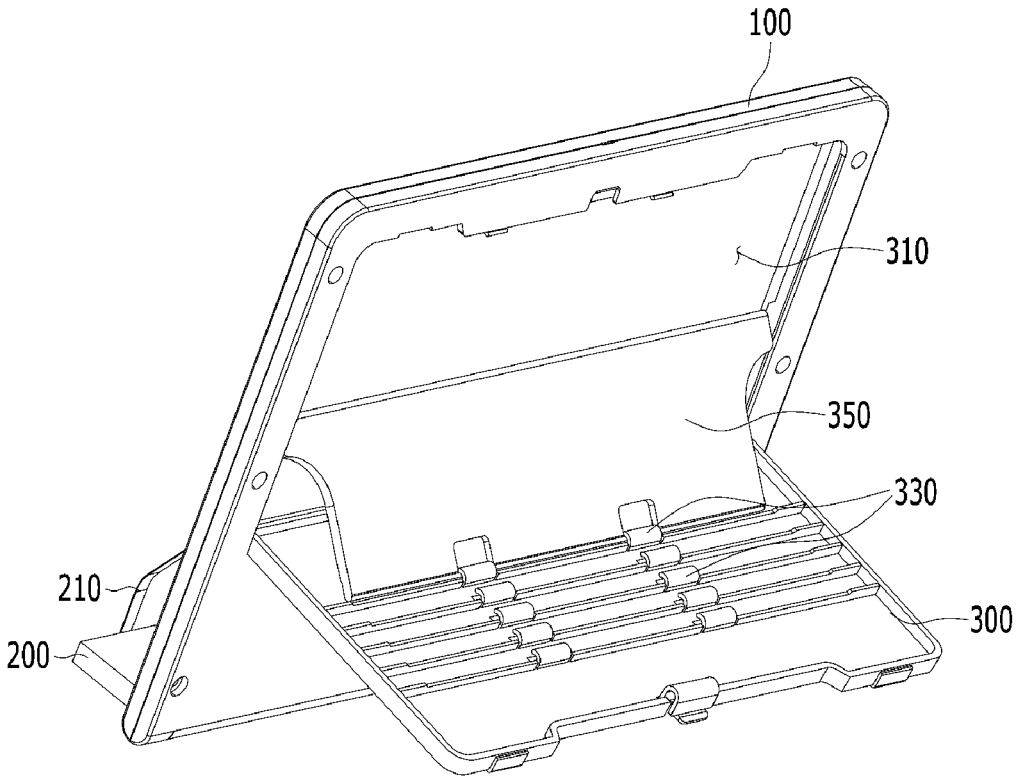
FIG. 11 is a perspective view showing a state in which an adjustment leg is unfolded.

FIG. 1 is a perspective view of a folded state of a portable reading stand according to the present invention. FIG. 2 is an exploded perspective view of the portable reading stand according to the present invention. FIG. 3 is a side cross-sectional view in which a base plate is folded. FIG. 4 is a side cross-sectional view in which the base plate is unfolded. FIG. 5 is a perspective view showing a state in which a cover is opened. FIG. 6 is a perspective view showing a state in which the base plate is unfolded. FIG. 7 is a view showing a state in which the cover is closed while the base plate is unfolded. FIG. 8 is a perspective view showing a state in which the base plate is unfolded state. FIG. 9 is a perspective view showing the rear of the portable reading stand according to the present invention. FIG. 10 is a perspective view showing a state in which a supporter is unfolded. FIG. 11 is a perspective view showing a state in which an adjustment leg is unfolded.

Referring to the drawing, the portable reading stand according to the present invention includes a main body panel 100 having a plate-shaped structure with a certain thickness, a base plate 200 provided to be rotatable on one side of one surface of the main body panel 100 to support a lower portion of a book, and a supporter 300 provided on the other surface of the main body panel 100 to obliquely support the main body panel 100.

One side (lower in FIG. 2) of the main body panel 100 is formed with a base accommodating unit 110 having one side recessed or stepped. The base accommodating unit 110 is configured to have a depth at which the base plate 200 and a cover 130, which will be described later, are overlapped to form a plane with the body panel 100.

The base plate 200 is coupled so that one side rotates to one side of the base accommodating unit 110 and the other side is configured as a free end. The base plate 200 is configured to be able to rotate up to a vertical direction with respect to the main body panel 100. Therefore, when the other side of the base plate 200 is folded in a direction of the main body panel 100, it may be accommodated in the base accommodating unit 110. In addition, when the other side of the base plate 200 is spread out of the main panel 100, a lower portion of a book may be supported while forming the vertical direction with respect to the main panel 100. A structure in which the base plate 200 is unfolded in the vertical direction with respect to the body panel 100 will be described later.

A pair of fixing members 210 may be provided on an end surface of the other side of the base plate 200. Various known forms may be applied to the fixing member 210. In a preferred embodiment of the present invention, the fixing member 210 may have a plate spring structure as shown in the drawings. The fixing member 210 with a leaf spring structure is composed of a metal plate having high elasticity in a shape of a bracket, so that one side is rotatably fixed to a side surface of the other side of the base plate 200 with a bolt or the like. The fixing member 210 is a known configuration, and detailed description thereof will be omitted.

The cover 130 is provided on an upper portion of the base accommodating unit 110 in one surface direction (a front direction of the body panel 100). Accordingly, when the cover 130 is closed while the base plate 200 is folded and accommodated in the base accommodating unit 110, all or part of the base plate 200 is covered by the cover 130. The cover 130 covers at least all of the fixing members 210 provided on the base plate 200. Therefore, when the cover 130 is closed, the base accommodating unit 110 formed on a front surface of the main body panel 100 is completely covered, so that a clean appearance may be realized. In addition, it is possible to prevent the fixing member 210 of the base plate 200 from being exposed to the outside or protruding to the outside. It is preferable that when the cover 130 is closed while the base plate 200 is accommodated in the base accommodating unit 110, one surface of the cover 130 is aligned with one surface of the main body panel 100 to form a plane.

In an embodiment of the present invention, the other side of the cover 130 is rotatably provided on the other side of the base accommodating unit 110, and one side is configured as a free end. It is preferable that when the cover 130 is closed while the base plate 200 is unfolded, the other end of the cover 130 faces the other surface of the base plate 200 and covers all of the base accommodating unit 110 (see FIG. 4). In addition, when the cover 130 is closed while the base plate 200 is accommodated, one surface of the cover 130 is parallel to the main body panel 100 (to be flat), while the other side is parallel to the other side of the base plate 200 (see FIGS. 1 and 3). Here, it is preferable that the other side of the base plate 200 is also parallel to the main body panel 100, so that the cover 130 and the base plate 200 are all flat when the cover 130 is closed while the base plate 200 is accommodated.

The portable reading stand according to the present invention may be provided with a base hole 230 in one direction of the base plate 200. The base hole 230 is formed to pass through a part of the base plate 200 in one direction. When the cover 130 is closed while the base plate 200 is unfolded, one end of the cover 130 facing the base plate 200 is partially exposed through the base hole 230. Specifically, one end of the cover 130 is positioned in the center of the base hole 230, and the base hole 230 has a shape extending so as to have a certain space in one side and the other side with respect to the cover 130. Accordingly, the cover 130 may be lifted by putting a finger into a lower space of the cover 130 through the base hole 230.

The cover 130 forms a plane parallel to the main body panel 100. Therefore, when the cover 130 is closed while the base plate 200 is unfolded, the cover 130 is inserted into the base accommodating unit 110 to form a plane with the body panel 100. As a result, it becomes difficult to open the cover 130 again. By forming the base hole 230 in the base plate 200 so that the cover 130 may be lifted by putting a finger in the base hole 230, a clean appearance may be realized and the cover 130 may also be easily opened. The base hole 230 may be used while charging when placing a smartphone or tablet PC on the reading stand by passing a charging cable of the smartphone or the tablet PC.

A cover support 150 protruding in a vertical direction is provided on a bottom surface of the base accommodating unit 110. The cover support 150 is provided at a position corresponding to the base hole 230 described above. Accordingly, when the base plate 200 is folded and accommodated in the base accommodating unit 110 or the base plate 200 is unfolded, the cover support 150 is positioned inside the base hole 230 so as not to be interfered with.

In addition, when the cover 130 is closed while the base plate 200 is unfolded, an inner surface of the cover 130 may be supported by the cover support 150. The cover 130 is provided on the base accommodating unit 110, in which if the inside of the cover 130 (the lower portion in the closed state) is not supported, there is a problem that the cover 130 is dented into the base accommodating unit 110. In a state in which the base plate 200 is accommodated in the base accommodating unit 110, no problem occurs because the cover 130 overlaps and closes on the base plate 200. However, when the base plate 200 is unfolded and the cover 130 is closed while the base accommodating unit 110 is empty, one direction of the cover 130 is dented into the base accommodating unit 110. When the cover support 150 is provided at a position corresponding to the base hole 230 formed in one direction of the base plate 200 and the cover 130 is closed while the base plate 200 is unfolded, while one side of the cover 130 is supported by the cover support 150, a plane with the main body panel 100 may be maintained.

The cover support 150 is configured to correspond to a distance between the bottom surface of the base accommodating unit 110 and the inner surface of the cover 130 when the cover 130 is closed. Here, the cover support 150 need not necessarily be integrally configured to protrude from the bottom surface of the base accommodating unit 110 to the lower portion of the cover 130. If necessary, the cover support 150 may be configured to have a first cover support 153 provided on the bottom surface of the base accommodating unit 110 and a second cover support 155 provided in the cover 130 at a position corresponding to the first cover support 153. Accordingly, the sum of the first cover support 153 and the second cover support 155 may correspond to the distance between the bottom surface of the base accommodating unit 110 and the inner surface of the cover 130 (see FIG. 3). When the cover support 150 is divided as described above, an area to be interfered with when the base plate 200 rotates is also narrowed, and durability is increased compared to a structure formed in a structure with a single long length.

According to an embodiment of the present invention, an upper end of the cover support 150 and the inner side of the cover 130 may be attached with a magnet. In other words, a magnet may be provided on one of the cover support 150 or the cover 130 at a position corresponding to the cover support 150, and a magnet or metal of opposite magnetic poles may be provided on the other side to be attached to each other. In addition, as described above, when the cover support 150 is configured to be divided into the first cover support 153 and the second cover support 155, an end of the first cover support 153 and an end of the second cover support 155 may be attached by a magnet. The cover 130 is always kept in a closed state when the base plate 200 is unfolded and used as a reading stand or when the base plate 200 is accommodated. When the base plate 200 is unfolded or folded, it should be easily opened and closed. Therefore, when the cover 130 and the cover support 150 are attached with a magnet, the cover 130 may have an appropriate support force while maintaining the closed state, and may be easily opened when a constant external force is applied.

Referring to FIGS. 3 and 4, in a driving structure of the base plate 200 of the portable reading stand according to the present invention, one end of the main body panel 100 is formed with a support end 170 bent from the rear to the front. The support end 170 is formed such that a first guide surface 190 having a round structure in which an outer surface is rounded in one direction extends. In addition, one end of the base plate 200 is formed with a second guide surface 250 having a rounded inner surface in one direction. The second guide surface 250 has an inner surface having a size and shape corresponding to the outer surface of the first guide surface 190. Accordingly, when the base plate 200 is unfolded, the inner surface of the second guide surface 250 slides along the outer surface of the first guide surface 190. When the base plate 200 reaches the vertical direction, an end of the second guide surface 250 stops while abutting against the support end 170 formed at a starting point of the first guide surface 190. The support end 170 and the first and second guide surfaces 190 and 250 may be provided on a front surface of the base plate 200 in the transverse direction to improve the support and have a rounded structure on one end surface to realize a clean appearance.

Referring to FIGS. 1, and 5 to 8, the portable reading stand according to the present invention may be stored or carried by folding the base plate 200 when not using the reading stand and storing it in the base accommodating unit 110 and then closing the cover 130. When using the reading stand, the cover 130 is opened (FIG. 5), the base plate 200 is unfolded (FIG. 6), and the cover 130 is closed again so that the base accommodating unit 110 is covered (FIGS. 7 and 8).

Even in the reading stand according to the prior art, a form in which a base plate is accommodated in a main body panel is disclosed. However, most of reading stands are provided with the fixing member 210 for supporting a page of a book on a pedestal. Therefore, in a base plate accommodating type reading stand according to the prior art, even if the base plate is accommodated, the fixing member and a space around the fixing member are exposed as it is. Such a structure may not implement a clean appearance, and the fixing member may rotate in a horizontal direction and may protrude outside the body panel. The fixing member 210 must rotate relatively easily in the horizontal direction due to its function, and when folded side by side on the base plate 200, it is supported by an elastic force. The fixing member 210 is easily rotated in the horizontal direction as the elastic force weakens or a fixing bolt become loose over time. Therefore, when there is no cover 130 as in the present invention, the fixing member 210 may easily protrude outside the main body panel 100 by an external force. Reading stands are often put in a bag and carried with books. When the fixing member 210 protrudes outward as described above, there may be a situation in which a book or the like is caught in the fixing member 210 and is damaged, or in some cases, a hand is injured by the fixing member 210. In addition, when the protruding fixing member 210 is caught by other external objects and bent more than elastic deformation, it is permanently deformed and a function of supporting a page of a book is lost. When the cover 130 is covered while the base plate 200 is accommodated as in the present invention, the aforementioned problem does not occur because the fixing member 210 does not protrude to the outside.

Even when the base plate 200 is unfolded and used as a reading stand, the base accommodating unit 110 is exposed as it is in the conventional base plate 200 accommodating reading stand. When the base accommodating unit 110 is exposed as described above, not only is it not desirable in appearance, but also various problems occur in terms of functionality. For example, when using a reading stand, school supplies such as writing instruments or a smartphone or tablet PC are placed on the base plate 200 of the reading stand and used in many cases. In some cases, thin documents such as A4 paper may be placed and used. When a recessed structure such as the base accommodating unit 110 is exposed on the base plate 200, the writing implement enters the base accommodating unit, and there is a lot of inconvenience in placing and using a smartphone or the like.

For example, a general size of the smallest reading stand among the reading stands is 270 mm in a landscape direction, and a length of the base plate 200 in a portrait orientation is usually about 35 to 45 mm. In order to accommodate the base plate 200 and the fixing member 210 in the base accommodating unit 110 together, a length of the base accommodating unit 110 in the portrait orientation must be at least 50 mm. There are some differences in sizes of the smartphones depending on the type, but the most common size is around 70 mm for a short side and 140 mm for a long side. A4 paper, which is mainly used for office documents, has a width of 210 mm. Therefore, both smart phones and office documents are shorter than a width of the base accommodating unit 110.

In general, when a user watches a video using a smartphone, it is mainly viewed with a long side in the landscape direction. When the smartphone is placed in the landscape direction on the reading stand where the base accommodating unit 110 is exposed, the entire landscape direction and two-thirds of the portrait orientation are positioned on the base accommodating unit 110. Therefore, when a screen of the smartphone is touched on the base accommodating unit 110, the smartphone cannot be stably supported, making it difficult to perform a normal touch operation. In addition, when placing A4 paper vertically on the reading stand, a lower portion thereof is not supported uniformly and a part is bent, and thus it will be pushed into the base accommodating unit 110. However, according to the present invention, even after the base plate 200 is unfolded, the cover 130 covers the base accommodating unit 110 so that the front surface of the main body panel 100 forms a flat appearance in the same way as a normal reading stand. Therefore, there is no inconvenience in using a smartphone or tablet PC, and no problem occurs even if an object of a size smaller than that of the base accommodating unit 110 is placed on the base plate 200.

In addition, there is no cover 130 in the case of the conventional base plate accommodating type reading stand. Therefore, when the base plate 200 is unfolded, the base accommodating unit 110 is exposed, so that foreign matter is easily introduced into the base accommodating unit 110. For example, when a book is placed on a reading stand and an eraser is used, debris of the eraser may flow into the base accommodating unit 110 and be caught in a hinge of the base plate 200. In this way, when the foreign matter flows into the hinge of the base plate 200, there is a problem that the rotation of the base plate 200 is hindered. Since a rotating part (hinge) of the base plate 200 is positioned inside the base accommodating unit 110, it is difficult for a user to remove the foreign matter. However, if the cover 130 completely covers the base accommodating unit 110 even when using the reading stand as in the present invention, the foreign matter does not flow into the base accommodating unit 110 (see FIG. 8).

Referring to FIGS. 9 to 11, the portable reading stand according to the present invention is provided with the supporter accommodating unit 310 on the other surface (rear surface) of the main body panel 100, and the supporter 300 is provided on the supporter accommodating unit 310. The supporter accommodating unit 310 is formed in a structure in which the other surface of the main body panel 100 is recessed. It is preferable that the supporter accommodating unit 310 is configured not to overlap with the base accommodating unit 110 described above. This is to reduce a thickness of the main body panel 100. Naturally, when the thickness of the main body panel 100 is a thickness capable of accommodating the base accommodating unit 110 and the supporter accommodating unit 310 at the same time, it may be configured to overlap. One side of the supporter 300 is rotatably coupled to one side of the supporter accommodating unit 310, and a plurality of locking protrusions 330 are provided on an inner surface thereof (referring to an inner surface in a folded state). An adjustment leg 350 is further provided inside the supporter 300 (referring to the inside in a folded state) in the supporter accommodating unit 310. One side of the adjustment leg 350 is rotatably coupled to the supporter accommodating unit 310, such that when the other side thereof is folded in the direction of the main body panel 100, the entire thereof is configured to be accommodated inside the supporter accommodating unit 310. Accordingly, when the adjustment leg 350 is folded and accommodated in the supporter accommodating unit 310, and the supporter 300 is folded and accommodated in the supporter accommodating unit 310, while the supporter 300 covers the adjustment leg 350, both the supporter 300 and the adjustment leg 350 are accommodated in the supporter accommodating unit 310. Here, it is preferable that the supporter 300 is configured in a shape corresponding to a shape of the supporter accommodating unit 310 so that the supporter accommodating unit 310 is covered when the supporter 300 is accommodated in the supporter accommodating unit 310. In addition, when the support 300 is accommodated in the supporter accommodating unit 310, the other surface of the support 300 is parallel to the other surface of the main body panel 100 (to be a plane) so that a clean flat appearance may be realized.

The locking protrusions 330 are formed at regular intervals on one surface (inner surface) of the supporter 300 so that the other end of the adjustment leg 350 is selectively caught on the locking protrusions 330, and thus an inclination angle of the reading stand may be adjusted. As long as it is a structure capable of supporting and fixing the supporter 300, various known shapes or structures may be applied to the locking protrusion 330. As an embodiment of the present invention, the locking protrusion 330 may be configured in a ring shape of a certain width as shown in the drawing, and the other end of the adjustment leg 350 may be provided with an adjustment coupling portion into which the locking protrusion 330 is inserted. Here, the adjustment coupling portion and the locking protrusion 330 may be coupled in a somewhat force-fitting type.

As described above, in the detailed description of the present invention, specific embodiments have been described, but naturally, various modifications are possible without departing from the scope of the present invention. Therefore, the scope of the present invention should not be defined by being limited to the described embodiments, and should be defined by the claims and equivalents as well as the claims to be described later.

What is claimed is:

1. A reading stand, comprising:

a main body panel having a plate-shaped structure with a thickness;

a base plate provided to be rotatable on a first side of a first surface of the main body panel to support a lower portion of a book; and a supporter provided on second surface opposite to the first surface of the main body panel to obliquely support the main body panel, wherein one side of the main body panel is provided with a base accommodating unit, wherein the base plate is configured such that a first side of the base plate is rotatably coupled to a first side of the base accommodating unit so that when a second side opposite to the first side of the base plate is folded in a direction of the main body panel, the base plate is accommodated in the base accommodating unit, wherein a cover is provided in a direction of a first surface of the base accommodating unit, such that when the cover is closed while the base plate is unfolded or while the base plate is folded and accommodated in the base accommodating unit, the base accommodating unit is covered.

2. The reading stand of claim 1, wherein a fixing member for supporting a page of the book is provided on a surface of an end of the second side of the base plate, such that when the base plate is folded in the direction of the main body panel while the fixing member is folded parallel to the base plate, it is accommodated in the base accommodating unit, and the cover is closed while the base plate is accommodated.

3. The reading stand of claim 1, wherein the cover has a first side and a second side opposite to the first side, and is configured such that the second side of the cover is coupled to rotate to a second side opposite to the first side of the base accommodating unit and one side is a free end.

4. The reading stand of claim 3, wherein when the cover is closed while the base plate is folded and accommodated, one surface of the cover is closed while being parallel to the first surface of the main body panel.

5. The reading stand of claim 4, wherein the cover is configured to cover the base accommodating unit while one end of the cover faces the second surface opposite to the first surface of the base plate when the cover is closed while the base plate is unfolded.

6. The reading stand of claim 1, wherein a base hole is provided in one direction of the base plate, such that when the cover is closed while the base plate is unfolded, a part of the cover is exposed through the base hole.

7. The reading stand of claim 6, wherein a cover support is provided at a position corresponding to the base hole on a bottom surface of the base accommodating unit, such that when the base plate is opened or closed, the cover support passes through the base hole, and such that when the cover is closed, the cover support supports an inner surface of the cover.

8. The reading stand of claim 7, wherein the cover support comprises a first cover support provided on the bottom surface of the base accommodating unit and a second cover support provided on the cover at a position corresponding to the first cover support.

9. The reading stand of claim 1, wherein one end of the main body panel is formed with a support end bent in a direction from a rear to a front of the reading stand, wherein the support end is formed such that a first guide surface having a round structure with a rounded outer direction extends, wherein one end of the base plate is formed with a second guide surface having a rounded inner surface in an outward direction, wherein the second guide surface is configured such that the inner surface corresponds to an outer surface of the first guide surface, such that when the base plate is unfolded, the inner surface of the second guide surface slides and moves along the outer surface of the first guide surface, and an end of the second guide surface rotates to abut the support end.

10. The reading stand of claim 1, wherein the second surface of the main body panel is provided with a supporter accommodating unit, wherein a first side of the supporter is rotatably coupled to one side of the supporter accommodating unit, and a plurality of locking means are provided in an inner side of the supporter, and wherein a first side of an adjustment leg is rotatably coupled to the supporter accommodating unit toward the inside of the supporter, such that when a second side opposite to the first side of the adjustment leg is folded in the direction of the main body panel, it is accommodated inside the supporter accommodating unit, and such that when the supporter is folded in the direction of the main body panel while the adjustment leg is accommodated, a second surface opposite to the first surface of the supporter is folded while being accommodated in the supporter accommodating unit in parallel with the second surface of the main body panel.

* * * * *